US007887697B2

(12) United States Patent
Worth

(10) Patent No.: US 7,887,697 B2
(45) Date of Patent: Feb. 15, 2011

(54) AROMATIC DRAIN DEVICE

(75) Inventor: Thomas W. Worth, Kenly, NC (US)

(73) Assignee: Mark Mangrom, Raleigh, NC (US)

( * ) Notice: Subject to any disclaimer, the term of this patent is extended or adjusted under 35 U.S.C. 154(b) by 0 days.

(21) Appl. No.: 11/382,541

(22) Filed: May 10, 2006

(65) Prior Publication Data

US 2007/0262006 A1 Nov. 15, 2007

(51) Int. Cl.

| | |
|---|---|
| ***E03F 5/14*** | (2006.01) |
| ***E03D 9/02*** | (2006.01) |
| ***A61L 9/00*** | (2006.01) |
| ***A61L 9/04*** | (2006.01) |

(52) U.S. Cl. ..... 210/164; 4/292; 4/222.1; 239/57; 239/60

(58) Field of Classification Search ..... None
See application file for complete search history.

(56) References Cited

U.S. PATENT DOCUMENTS

| | | | | | |
|---|---|---|---|---|---|
| 852,044 | A | * | 4/1907 | Van Der Minden | 4/291 |
| 931,019 | A | * | 8/1909 | Dawes | 4/288 |
| 1,107,485 | A | * | 8/1914 | Bowser | 210/304 |
| 1,195,827 | A | * | 8/1916 | Lucke | 4/693 |
| 1,515,073 | A | * | 11/1924 | Savard | 4/289 |
| 1,612,588 | A | * | 12/1926 | Lacoste | 4/291 |
| 1,622,652 | A | * | 3/1927 | Lang | 210/164 |
| 1,751,877 | A | * | 3/1930 | Nance | 4/679 |
| 1,756,290 | A | * | 4/1930 | Hibner | 4/289 |
| 1,773,640 | A | * | 8/1930 | Prasivka | 210/251 |
| 1,880,962 | A | * | 10/1932 | Koppelman | 4/309 |
| 1,959,623 | A | * | 5/1934 | Gordon | 210/301 |
| 1,966,074 | A | * | 7/1934 | Fuld | 4/222.1 |
| 1,988,669 | A | * | 1/1935 | Sommerfeld | 210/166 |
| 2,046,214 | A | * | 6/1936 | Selig | 4/222.1 |
| 2,059,524 | A | * | 11/1936 | Hoffman | 4/222.1 |
| 2,087,341 | A | * | 7/1937 | Farmer | 4/222.1 |
| 2,087,592 | A | * | 7/1937 | Chesnut | 510/195 |
| 2,136,945 | A | * | 11/1938 | Klein | 137/247.35 |
| 2,182,795 | A | * | 12/1939 | Day | 210/164 |
| 2,246,012 | A | * | 6/1941 | Sanders | 210/163 |
| 2,654,097 | A | * | 10/1953 | Epstein | 4/291 |
| 2,689,017 | A | * | 9/1954 | Schmid | 210/164 |
| 2,783,852 | A | * | 3/1957 | Sisk | 210/165 |
| 2,800,231 | A | * | 7/1957 | Hicks | 210/463 |
| 2,928,419 | A | * | 3/1960 | Kruse | 210/163 |
| 3,112,499 | A | | 12/1963 | Thornton | |
| 3,239,149 | A | * | 3/1966 | Lindberg, Jr. | 239/203 |

(Continued)

FOREIGN PATENT DOCUMENTS

JP 10159147 A * 6/1998

(Continued)

OTHER PUBLICATIONS

Machine Translation of P 2004-176301 A; 18 pages.*

*Primary Examiner*—Robert James Popovics
(74) *Attorney, Agent, or Firm*—The Parker Law Office, PLLC; DeLeon Parker, Jr.

(57) ABSTRACT

An aromatic drain device comprising a perforate retaining device defining a volume for retaining an aromatic media therein, the retaining device releasably secured to a removable drain cover and positioned to extend below the drain cover into the cavity defined by the floor drain wall.

2 Claims, 5 Drawing Sheets

U.S. PATENT DOCUMENTS 3,349,917 A * 10/1967 Strickland ..... 210/164
3,469,700 A * 9/1969 Johnson ..... 210/238
3,597,772 A * 8/1971 Leavitt et al. ..... 4/222
3,667,611 A * 6/1972 Pansini ..... 210/244
3,713,539 A * 1/1973 Thompson et al. ..... 210/164
3,760,429 A * 9/1973 Brownstein ..... 4/222.1
3,982,289 A * 9/1976 Robbins ..... 4/292
4,035,297 A * 7/1977 Aldridge et al. ..... 210/163
4,103,367 A * 8/1978 Kaufer ..... 4/222
4,134,162 A * 1/1979 Sharland et al. ..... 4/292
4,135,261 A * 1/1979 Uhrman ..... 4/222
4,222,755 A * 9/1980 Grotto ..... 55/291
4,224,701 A 9/1980 Huang
4,257,892 A * 3/1981 Boersma ..... 210/163
4,318,193 A 3/1982 Bayer et al.
4,459,209 A * 7/1984 Broadwater ..... 210/167.16
4,460,462 A * 7/1984 Arneson ..... 210/163
4,505,814 A * 3/1985 Marshall ..... 210/166
4,507,203 A * 3/1985 Johnston ..... 210/445
4,574,400 A * 3/1986 Annowsky ..... 4/222.1
4,799,713 A * 1/1989 Uglow ..... 285/42
4,890,791 A * 1/1990 Hoffman ..... 239/44
5,019,346 A * 5/1991 Richter et al. ..... 422/28
5,037,541 A 8/1991 Ruey-Jang et al.
5,062,735 A * 11/1991 Gaudin ..... 404/25
5,141,633 A * 8/1992 Walczak et al. ..... 210/163
5,165,119 A * 11/1992 Yamato ..... 4/309
D332,302 S * 1/1993 Brown ..... D23/261
5,249,398 A * 10/1993 Spanberg ..... 52/169.5
5,329,971 A * 7/1994 Condon ..... 138/89
5,365,616 A * 11/1994 Morad ..... 4/309
D353,445 S * 12/1994 Morad ..... D23/261
5,378,356 A * 1/1995 Logsdon ..... 210/163
5,398,347 A * 3/1995 Luedtke et al. ..... 4/301
5,443,327 A * 8/1995 Akkala et al. ..... 405/118
5,469,670 A * 11/1995 Thaler ..... 52/12
5,486,287 A * 1/1996 Murphy et al. ..... 210/164
5,527,131 A * 6/1996 Salmond et al. ..... 405/52
5,604,937 A * 2/1997 Davenport ..... 4/309
5,618,416 A * 4/1997 Haefner ..... 210/163
5,695,222 A * 12/1997 Hodges ..... 285/3
5,724,777 A * 3/1998 Hubbard ..... 52/198
5,966,884 A * 10/1999 Uglow ..... 52/302.1
6,108,828 A * 8/2000 Cheng ..... 4/287
6,165,357 A * 12/2000 Cormier ..... 210/163
6,197,321 B1 3/2001 Richter et al.
6,200,484 B1 * 3/2001 McInnis ..... 210/693
6,202,749 B1 * 3/2001 Adams et al. ..... 166/227
6,254,770 B1 * 7/2001 Remon ..... 210/163
6,263,518 B1 * 7/2001 Magtanong ..... 4/289
6,269,490 B1 * 8/2001 Suski et al. ..... 4/309
6,315,896 B1 * 11/2001 Johnson ..... 210/164
6,403,032 B1 6/2002 Abercrombie et al.
6,490,738 B2 * 12/2002 Blaney ..... 4/287
6,491,814 B1 12/2002 Wheeler
6,537,447 B2 * 3/2003 Remon ..... 210/163
6,537,448 B2 * 3/2003 Houk ..... 210/164
6,588,029 B2 * 7/2003 Mullings ..... 4/507
6,631,588 B1 * 10/2003 Distler ..... 52/12
6,743,354 B1 * 6/2004 Evans et al. ..... 210/164
6,833,067 B2 * 12/2004 Dresmann ..... 210/163
6,920,648 B1 * 7/2005 Suski et al. ..... 4/309
6,927,199 B2 8/2005 Takemura et al.
7,011,746 B2 * 3/2006 Bockmann ..... 210/164
7,013,500 B1 * 3/2006 Lin ..... 4/287
7,098,174 B2 * 8/2006 Takemura et al. ..... 510/195
7,178,179 B2 * 2/2007 Barnes ..... 4/507
7,300,573 B1 * 11/2007 Trangsrud ..... 210/163
7,473,359 B1 * 1/2009 Barrett, II ..... 210/232
7,618,532 B2 * 11/2009 Worth ..... 210/164
2003/0159384 A1 * 8/2003 Warnecke ..... 52/302.1
2004/0182763 A1 * 9/2004 Bockmann ..... 210/164
2005/0135979 A1 6/2005 Gootter
2007/0262006 A1 * 11/2007 Worth ..... 210/164
2009/0026285 A1 * 1/2009 Worth ..... 239/57

FOREIGN PATENT DOCUMENTS

JP 2001073431 A * 3/2001
JP 2004-176301 A * 6/2004

* cited by examiner

SEC. AA

SEC. BB

SEC. BB

AROMATIC DRAIN DEVICE

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of Invention

This invention relates generally to floor drains and, more specifically, to a device positioned inside a floor drain for deodorizing public facilities and the like.

2. Description of the Prior Art

Many public facilities having floor drains suffer from odor problems emanating from the floor drain. This problem is especially prevalent in public restrooms. As facilities are cleaned, dirt, grime, and bacteria collect in the floor drain p-trap. The water in the p-trap quickly becomes dirty and emanates foul odor into the room and adjacent areas.

Currently, the prevailing solution to this problem is the use of sanitizing liquids. These liquids are typically poured down the floor drain on a regular basis. However, the solution is quickly washed down the drain and out of the trap with subsequent cleanings. Additionally, the sanitizing liquid does not provide continuous aroma to the room.

Other common solutions include the use of wall-mounted, time-release deodorizer sprayers. These devices systematically release aroma into the room to mask odors at predetermined time intervals. These systems also do not provide a continuous release of aroma into the room. While these devices mask foul odors immediately following discharge, the active aromatic agents quickly disperse into the room, failing to effectively mask or eliminate the odors.

Yet other devices attempt to place deodorizing and sanitizing agents inside the drain. These devices typically address either sink drains or floor drains. Most of these devices require special drain modifications to hold the device, increasing expense to the owner and making them impractical for contractor installation. These devices may also have the tendency to aggravate drain problems by catching dirty water around the device.

U.S. Pat. No. 6,491,814 to Wheeler discloses a solid, dissolving tablet filter attached to the underside of a drain cover by a hook. The filter allows water to pass through the filter. The filter catches debris that the drain cover does not stop. The filter should be removed and cleaned periodically since it may become clogged from debris that does not pass through the filter. Additionally, the device is susceptible to becoming easily dislodged from the drain cover and falling into the drain.

SUMMARY OF THE INVENTION

The present invention is directed to an aromatic drain device attachable to and suspending below a floor drain cover. The device comprises a retaining device that retains an aromatic media that continually releases pleasant fragrances to mask or eliminate foul odors emanating from the floor drain. The device provides for extending release periods and is simple and easy to change without obstructing drain flow. A drip feed dispenser attaches to the retaining device bottom dispensing drops of aromatic liquid onto the floor drain wall to further facilitate deodorizing action. The drip dispenser's aromatic liquid may also contain a sanitizing agent to facilitate elimination of germs and bacteria on the floor drain wall and in the liquid contained in the drain p-trap.

It is therefore an object of the present invention to provide a novel aromatic device for masking or eliminating odors emanating from the floor drain.

It is an object of the present invention to provide an aromatic device easily securable to a floor drain.

It is an object of the present invention to provide an aromatic drain device that can utilize a variety of aromatic media.

It is an object of the present invention to provide an aromatic device that provides continual aromatic action for an extending duration.

It is an object of the present invention to provide an aromatic drain device providing quick, easy replacement of aromatic media.

It is an object of the present invention to provide an aromatic device that also dispenses drops of aromatic liquid onto the floor drain wall.

To achieve the foregoing objects, and in accordance with the purpose of the invention as broadly described herein, the present invention provides an aromatic drain device securably attaching to a drain cover.

In a first aspect, the device comprises a retaining device securably attached to, and suspending below, a drain cover, wherein the retaining device is formed of perforated material and defines a volume having an aromatic media retained inside so that air flows through the device carrying fragrance from the aromatic media to the room in which the drain is located.

In a second aspect, the device comprises a retaining device that may be easily and quickly removed from the floor drain facilitating quick replacement of aromatic media, wherein the retaining device holds either solid, gel based, or liquid based aromatic media.

In a third aspect of the invention, the device comprises a retaining device separably formed into a bottom section releasably securing to a top bottom section and forming an air gap there-between, whereby the bottom section retains the aromatic media and is quickly removable to facilitate changing of the aromatic media.

In a fourth aspect of the invention, the device further comprises a liquid dispenser for dispensing aromatic liquid onto the floor cavity wall to enhance the masking and elimination of foul odors emanating from a floor drain, wherein the aromatic liquid may include a sanitizing agent to kill bacteria and germs on the wall of the floor drain.

In a fifth aspect of the invention, the device comprises a retaining device having a top section that diverts water flowing down through the drain cover away from the retaining device and the aromatic media held therein.

The present invention will now be described with reference to the following drawings, in which like reference numbers denote the same element throughout.

DESCRIPTION OF THE PREFERRED EMBODIMENT

Figure 1:
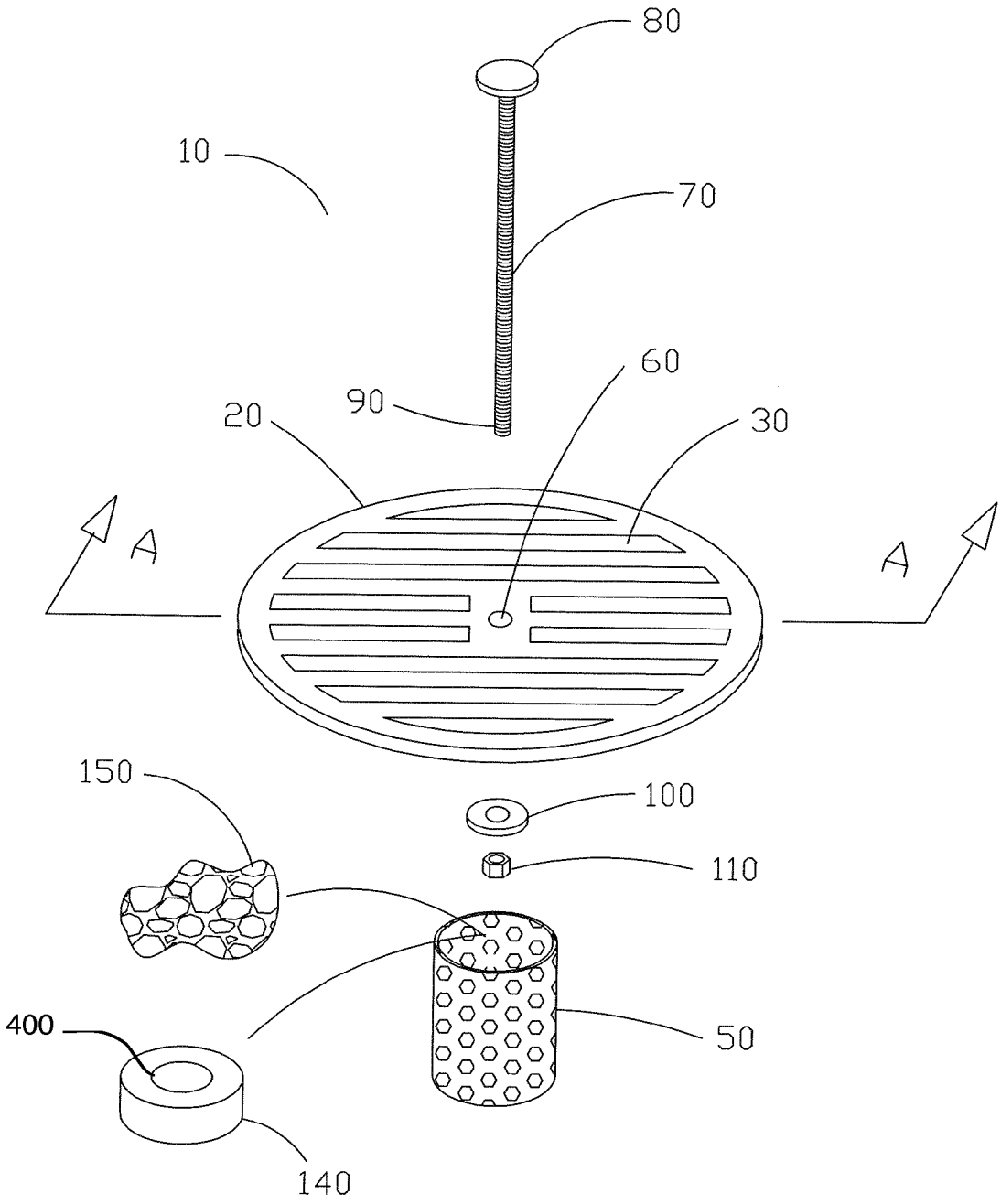
FIG. 1 is an assembly view of the present invention attaching to a typical floor drain cover.
Figure 2:
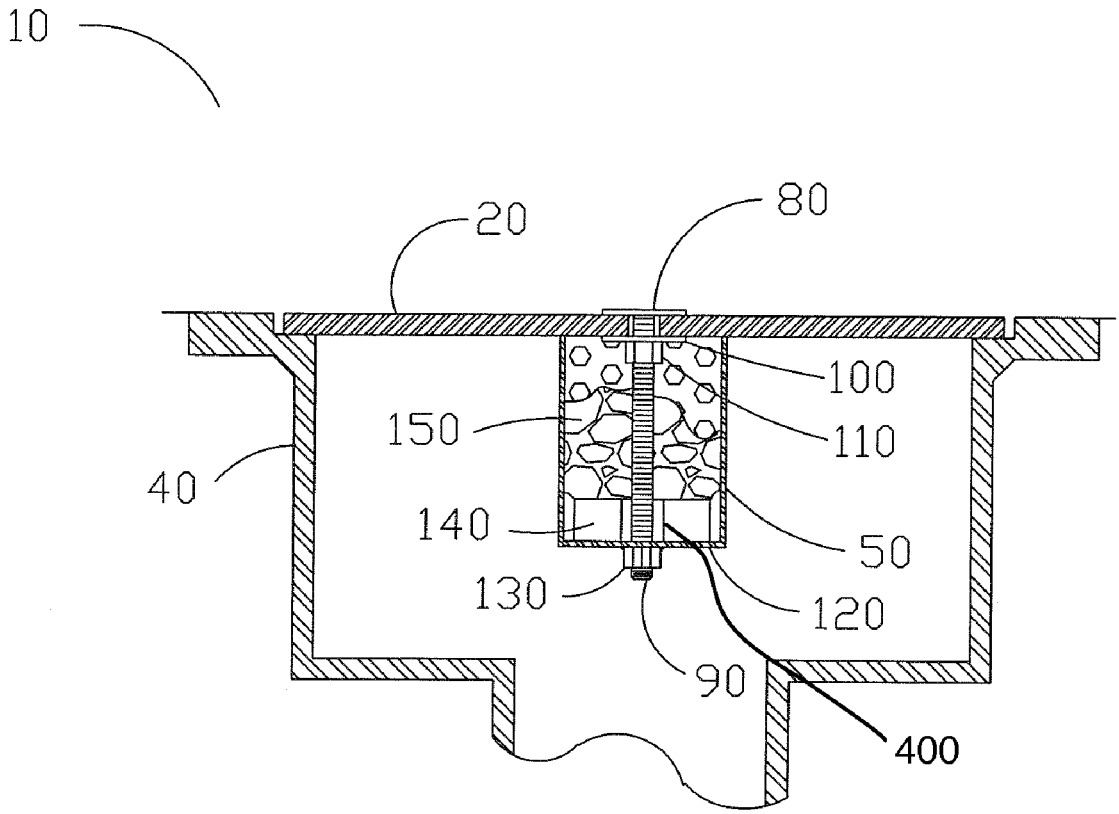
FIG. 2 is a cross-sectional elevation view of the present invention attached to a floor drain.

Referring now to the drawings in greater detail, FIG. 1 and FIG. 2, an aromatic floor drain device 10 is shown. A floor drain cover 20 has a plurality of drain openings 30 formed therein. The drain openings 30 allow water and debris washed from the floor to pass through the openings and into the floor drain 40. The drain cover 20 removably secures to a floor drain 40. A retaining device 50 defining a volume therein releasably secures to the drain cover 20. In the illustrated embodiment, the drain cover 20 has a bolt opening 60 centrally formed therein. The bolt opening 60 is adapted to receive an elongated threaded bolt 70 having a flat head 80 and a free end 90. The bolt opening 60 receives the threaded bolt 70 so that the flat head 80 is essentially flush with the top of the drain cover 20 while the free end 90 extends below the drain cover 20 and into the cavity defined by the floor drain 40. The bolt opening 60 may be countersunk to allow the flat head 80 to recess into the top of the drain cover 20. Though not illustrated, this arrangement further ensures so that the flat head 80 is not likely to present a tripping hazard. Alternatively, the threaded bolt 70 may be placed through one of the drain openings 30 in lieu of placement in a specially formed bolt opening 60. If this alternative arrangement is utilized, the threaded bolt 70 should be secured in a central location on the drain cover 20.

A washer 100 and lock nut 110 engage the threaded bolt 70 on the bottom side of the drain cover 20 that is adjacent to the floor drain 40 cavity. The lock nut 110 secures the threaded bolt 70 to the drain cover 20. The provided retaining device 50 is preferably cylindrically shaped defining a cylindrical volume therein. The retaining device 50 has one end open and a second end closed defining a bottom 120. The retaining device 50 has a sufficient number of perforations or openings formed therein to allow liquids and solids that would pass through the drain cover 20 to pass freely through the retaining device 50. This may be achieved by using a retaining device 50 constructed of wire mesh having large diameter openings, or other solid materials having perforations sufficiently large to allow the passage of the liquids and solids.

The retaining device 50 has a device securing means 130 for securing the retaining device 50 to the drain cover 20 bottom. In the illustrated embodiment, the retaining device 50 is adapted to communicably receive the threaded bolt 70 free end 90. The device securing means 130 is a nut centrally located and affixed on the bottom 120 of the retaining device 50. The nut is adapted to engage the free end 90 of the threaded bolt 70 received through the retaining device 50. This arrangement allows a user to easily screw the retaining device 50 onto the threaded bolt 70 thereby securing the retaining device 50 to the drain cover 20. In this arrangement, the free end 90 of the threaded bolt 70 may be adapted to receive a cotter key or similar securing means to provide a secondary retention means to ensure that the retaining device 50 does not accidentally become unsecured and fall into the drain.

As illustrated, the threaded bolt 70 has a length sufficiently longer than the sum of the drain cover 20 thickness, the axial length of the retaining device 50, and the thickness of the device securing means 130 to provide a free end 90 having sufficient threads to provide for the cotter key or other secondary retention means.

An aromatic media is provided that is adapted in shape to fit inside the volume defined by the retaining device 50. The aromatic media may take one of many forms. In the illustrated embodiment, two different forms are illustrated. One form is a deodorizing aromatic solid 140 preferably having a cylindrical shape. The axial opening 400 defined by the cylindrical shape of the aromatic solid 140 allows the threaded bolt 70 to pass axially through the aromatic tablet. The aromatic solid 140 may be composed of any of a number of deodorizing solids that are well known to those skilled in the art of deodorizing and sanitizing chemicals. The aromatic solid 140 is preferably of a type that sublimates so that the deodorizing aroma is continuously emitted into the air. Additionally, sanitizing agents may be impregnated into the aromatic solid 140 so that as water flows through the device 10 and over the aromatic solid 140 the sanitizing agent is released. Alternatively, a sponge 150 soaked with an aromatic liquid may be placed inside the retaining device 50. The aromatic liquid 250 evaporates from the sponge 150 emitting a pleasant aroma into the air. The sponge 150 may be adapted to form a cylindrical shape, the axial opening 400 of which allows the threaded bolt 70 to pass there-through. Other embodiments could include specially shaped containers 240, adapted to fit within the volume defined by the retaining device 50, holding liquid or gelatinous-based deodorizing agents.

In operation, a sponge 150 soaked with liquid aromatic deodorizing agent has been found to effectively provide deodorizing capability in excess of 45 days. Thus, the device 10 is able to provide elongated periods wherein pleasant aromas are released, effectively masking or eliminating the foul odors emanating from the floor drain 40. To operate the device 10, the threaded bolt 70 secures to the drain cover 20 with the flat head 80 flush with the drain cover 20 and floor surface. The free end 90 of the threaded bolt 70 extends perpendicularly and outwardly from the bottom surface of the drain cover 20 and into the cavity defined by the floor drain 40. The user places the aromatic media into the open end of the retaining device 50. The aromatic media generally rests on the bottom 120 of, and inside the volume defined by, the retaining device 50. The threaded bolt 70 inserts into the open end of the retaining device 50, through the opening in the bottom 120, and engages the device securing means 130. The user turns the retaining device 50 to engage the device securing means 130 nut onto the free end 90 of the threaded bolt 70. The user continues to screw the retaining device 50 until the open end of the retaining device 50 is flush against the bottom side of the drain cover 20. The retaining device 50 should be screwed hand tight to ensure a snug fit. The cotter key or other secondary retaining means is placed on the threaded bolt 70 free end 90. Finally, the drain cover 20 engages the floor drain 40 using the removable securing means provided with the drain cover 20. To replace the aromatic media, the drain cover 20 is simply removed, the secondary retaining means is removed (if provided), and the retaining device 50 is unscrewed from the threaded bolt 70 allowing the user to replace the aromatic media.

Figure 3:
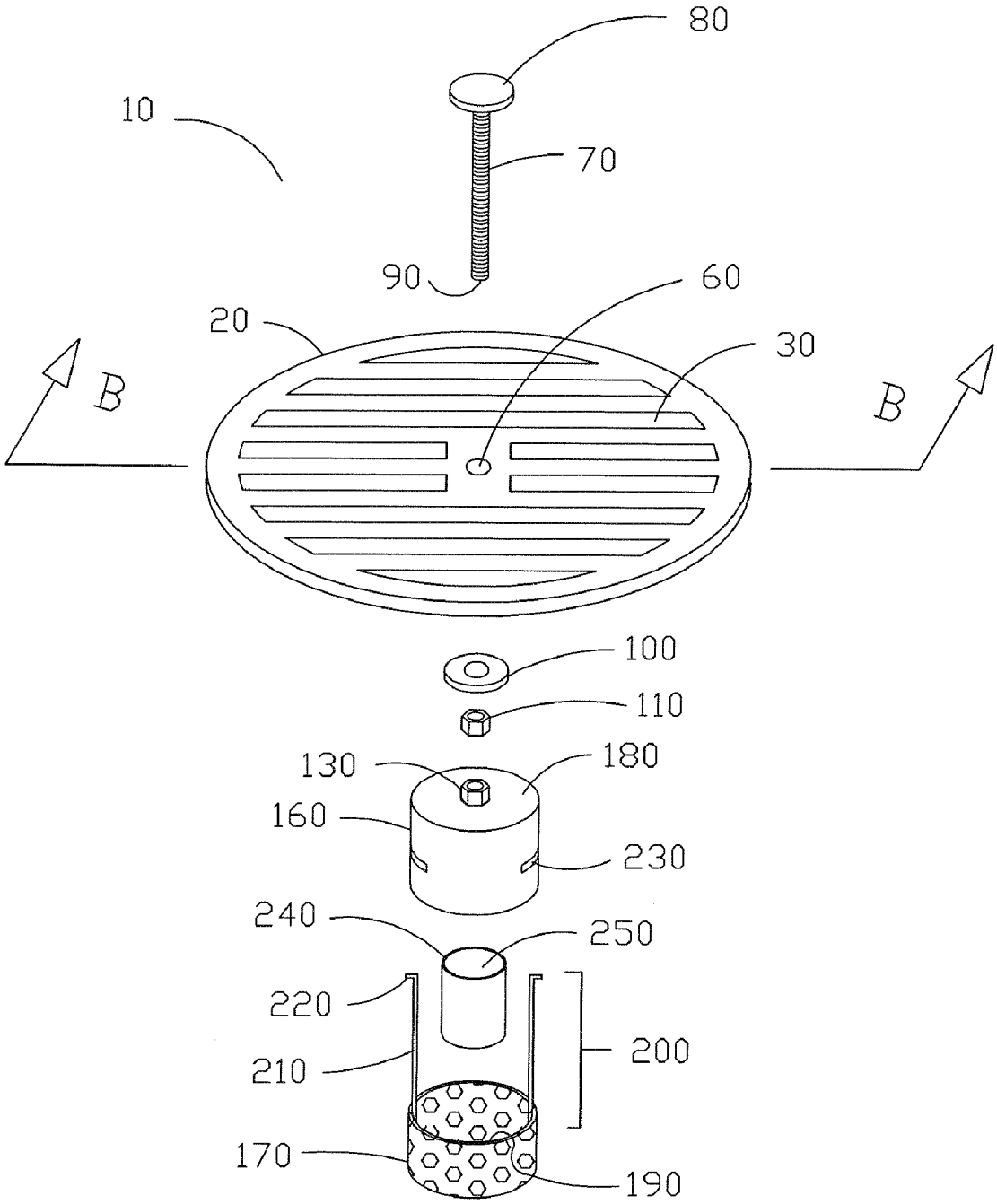
FIG. 3 is an assembly view of a second embodiment of the present invention having a top section and a bottom section.
Figure 4:
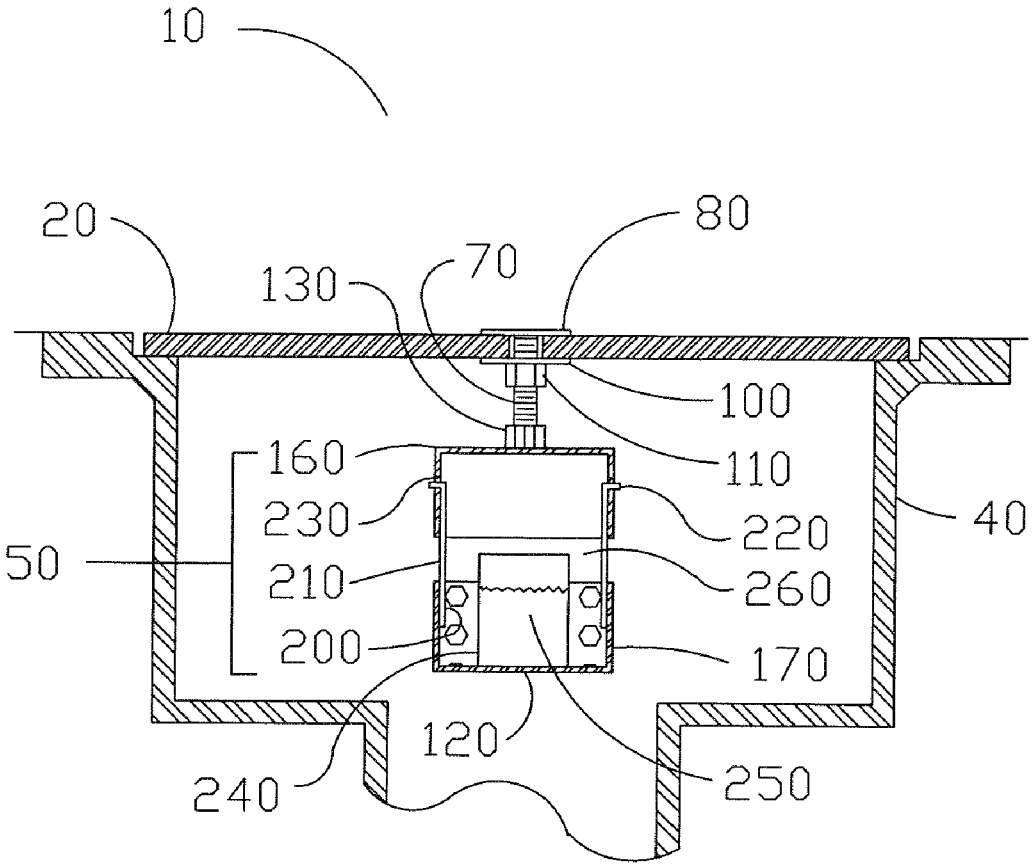
FIG. 4 is a cross-sectional elevation view of a second embodiment of the present invention having a top section and a bottom section.

FIG. 3 and FIG. 4 illustrate a second embodiment of the present invention. As with the first embodiment, the drain cover 20 is adapted to receive a threaded bolt 70 through either a bolt opening 60 or one of the plurality of drain openings 30 defined there-through. A washer 100 and lock nut 110 secure the threaded bolt 70 to the drain cover 20 so that the free end 90 of the threaded bolt 70 extends perpendicularly away from the drain cover 20 bottom and into the cavity defined by the floor drain 40.

In this embodiment, the retaining device 50 is also preferably cylindrically shaped and separably formed into a top section 160 and a bottom section 170. The top section 160 is cylindrically shaped having an open end while the other end is closed defining a top 180. In the illustrated embodiment, the device securing means 130 is a nut centrally and fixedly attached to the top section 160 top 180. In this embodiment the device securing means 130 should secure the top section 160 to the drain cover 20. Other suitable means may also be used to fixedly secure the top section 160 to the underside of the drain cover 20. The top section 160 is preferably formed of a solid plastic or sheet metal. The top section 160 is adapted to effectively divert water away from the device 10 and away from the inner volume defined by the device 10.

The bottom section 170 is also preferably cylindrically shaped having a wall 190 and a closed end forming a bottom 120. The other end of the bottom section 170 defines an opening. The bottom section 170 is fabricated from a perforated material permitting any water or debris that washes into the bottom section 170 to flow freely through and out of the retaining device 50. A plurality of elongated, springy retainer clips 200 have one end affixed to the bottom section wall 190, a body portion 210, and a catch 220. The body portion 210 of the bottom section 170 extends beyond the opening defined by the bottom section wall 190 in a direction perpendicular to the bottom 120 and parallel with the bottom section 170 axis. The end spaced distally from the bottom section 170 is adapted into a catch 220. In the illustrated embodiment, the catch 220 extends radially outwardly from the bottom section 170 axis in a plane perpendicular to the body portion 210.

The retaining device 50 top section 160 is adapted to securably receive the catch 220 from each retainer clip 200. In the illustrated embodiment, the top section 160 has a series of slots 230 formed therein for receiving the retainer clips 200. In operation, a user depresses the body portion 210 of the retainer clips 200 radially inward so that the catch 220 of each clip can be inserted into the open end of the top section 160. When pressure is released, the body portion 210 springs back to shape inserting the catch 220 into the corresponding slot 230. The catch 220 is of sufficient length to extend beyond the top section 160 outer surface. The retainer clip 200 should be constructed of a durable, flexible, shape-retaining material capable of quickly springing back to shape after depression or deformation of normal use. The retainer clips 200 provide for easy removal and secure attachment of the bottom section 170 to the top section 160. The catch 220 ensures that the bottom section 170 securably attaches to the top section 160 and does not accidentally dislodge and fall into the drain.

As with the first described embodiment, a sponge 150 soaked with aromatic liquid or an aromatic solid 140 may be placed into the retaining device 50. Additionally, this second embodiment is well suited to hold a container 240 of aromatic liquid 250. Since the top section 160 diverts liquids pouring through the drain cover 20 away from the device 10, dirty water and debris washed from the facility floor into the drain cannot enter the container 240 held inside the retaining device 50. Thus, an aromatic liquid 250 will not wash out of the container 240 held inside the retaining device 50. Whether an aromatic liquid 250 is used that evaporates into the air, or an aromatic solid 140 that sublimates, the perforations in the bottom section 170 allow treated air to exit the retaining device 50 and mask the foul odors emanating from the door drain. To facilitate this action, the body portion 210 of the retainer clips 200 should be sufficiently long to allow the bottom section 170 to hang from the top section 160, forming a gap 260 between the top section 160 and bottom section 170 through which air can freely circulate.

In operation, the threaded bolt 70 is securably attached to the drain cover 20 as previously described. The top section 160 is threaded onto the free end 90 of the threaded bolt 70. A cotter key or set screw may also be used to secure the top section 160 in place. An appropriate aromatic media inserts into the bottom section 170 open end and rests on the bottom 120. The body portions 210 are depressed while each catch 220 inserts into the open end of the top section 160. The retainer clips 200 are released and the body portion 210 springs back to shape inserting the catch 220 of each retaining clip into the corresponding slot 230 in the top section 160. Finally, the drain cover 20 engages the floor drain 40 using the removable securing means provided with the drain cover 20. To replace the aromatic media, the drain cover 20 is removed, the body portion 210 of the retainer clips 200 are depressed, and the bottom section 170 is removed from the top section 160. A new aromatic media replaces the spent aromatic media.

Figure 5:
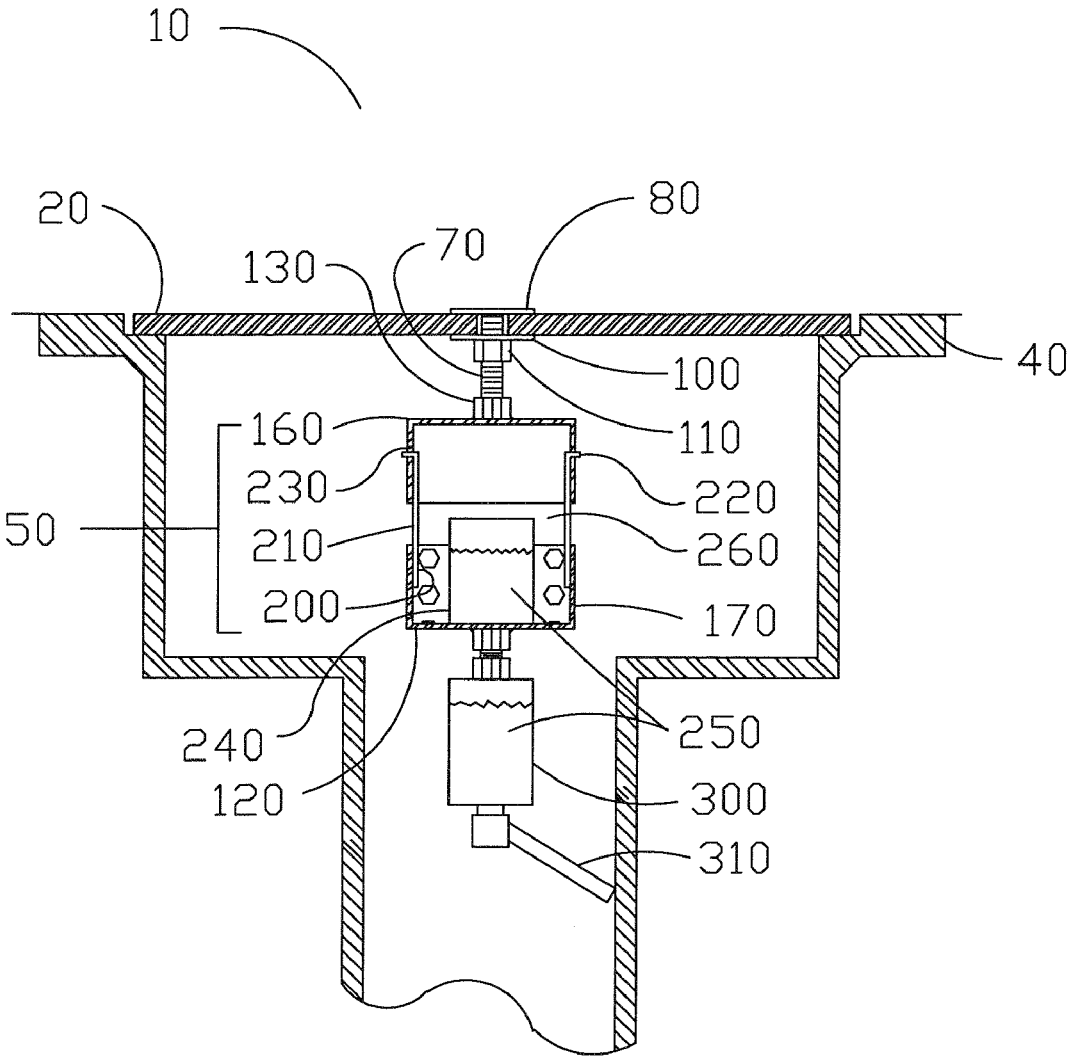
FIG. 5 is a cross-sectional elevation view of the second embodiment of the present invention having an aromatic drip dispenser affixed thereon.

Referring now to FIG. 5, to further facilitate aromatic activity, a liquid aromatic dispenser 300 may be provided. The dispenser 300 mounts to the bottom 120 of the retaining device 50 and extends down into the cavity defined by the floor drain 40. The dispenser 300 may also be removably secured to the retaining device 50 by wire hangers, clips, screws, or other suitable removable fastening means. The dispenser 300 defines a volume that is filled with aromatic liquid 250. The dispenser 300 has a drip feed means 310 disposed on the bottom 120 of the dispenser. The drip feed means 310 communicates aromatic liquid 250 at a predetermined rate from the volume defined by the dispenser 300 to the floor drain 40. The aromatic liquid 250 drips down the floor drain 40, releasing additional pleasing aromas into the air. Aromatic liquid 250 drying on the floor drain 40 reactivates when water pours down the drain and re-wets the affected portion of the floor drain 40. In the illustrated embodiment, the drip feeds means 310 is an elongated annular member extending angularly outwardly from the dispenser 300 to the floor drain 40. The end of the annular member disposed towards the floor drain 40 preferably touches the floor drain 40 and is formed into an aperture that releases drops of liquid at a predetermined rate. Those skilled in the art of dispensers will appreciate various other means of dispensing aromatic liquid onto the drain.

As has been demonstrated, the present invention provides a novel aromatic drain device and method of use continual masking and elimination of odors emanating from floor drains for extended durations. The present invention could be used with a variety drain covers and floor drain designs. Additionally, a variety of aromatic media could be used including those having solid, liquid or gel bases. The prior art does not provide teachings in an aromatic drain device attached to a floor drain cover that provides continual, extended aromatic action without presenting a drain clogging problem. Further, the prior art does not teach an aromatic drain device that effectively utilizes a variety of aromatic media in the same device. Further, the prior art does not teach an aromatic drain device for floor drains that securely attaches to a drain cover without requiring special modification to the modification of the floor drain or use of special manufactured floor drain components.

While the preferred embodiment of the present invention has been described, additional variations and modifications in that embodiment may occur to those skilled in the art once they learn of the basic inventive concepts. Therefore, it is intended that the appended claims shall be construed to include both the preferred embodiment and all such variations and modifications as fall within the spirit and scope of the invention.

I claim:

1. An aromatic device attachable to a drain cover for providing a pleasant fragrance for masking or elimination of odors emanating from a floor drain comprising:

a perforated retaining device having a wall defining an open top adjacent the drain cover, the wall extending downwardly from the drain cover terminating in a closed end defining a bottom supporting a cylindrical aromatic solid having an axial opening therethrough;

a threaded bolt having a head and a free end, the free end extending downwardly through a one of a plurality of openings in the drain cover;

the aromatic solid axial opening encircling a portion of the threaded bolt free end passing therethrough;

the threaded bolt free end passing through the bottom and engaging a nut for releasably securing the retaining device under the drain cover.

2. A method of eliminating odors emanating from a floor drain comprising:

passing a threaded bolt free end downwardly through a drain cover opening;

inserting a cylindrical aromatic solid having an axial opening therethrough into a perforate retaining device positioned to extend below the drain cover, the retaining device having a bottom and further defining a volume therein;

passing the threaded bolt free end through the aromatic solid axial opening;

engaging a nut with the threaded bolt free end thereby releasably attaching the retaining device to the drain cover;

engaging the drain cover with the floor drain.

* * * * *